US009390879B2

(12) United States Patent
Lidstrom

(10) Patent No.: US 9,390,879 B2
(45) Date of Patent: Jul. 12, 2016

(54) MAGNETRON POWER SUPPLY

(75) Inventor: Kjell Lidstrom, Burea (SE)

(73) Assignee: Ceravision Limited, Milton Keynes (GB)

( * ) Notice: Subject to any disclaimer, the term of this patent is extended or adjusted under 35 U.S.C. 154(b) by 0 days.

(21) Appl. No.: 13/809,600

(22) PCT Filed: Jul. 12, 2011

(86) PCT No.: PCT/GB2011/001048

§ 371 (c)(1), (2), (4) Date: Feb. 12, 2013

(87) PCT Pub. No.: WO2012/007713

PCT Pub. Date: Jan. 19, 2012

(65) Prior Publication Data

US 2013/0134872 A1 May 30, 2013

(30) Foreign Application Priority Data

Jul. 13, 2010 (GB) ..... 1011789.3

(51) Int. Cl.
*H01J 23/34* (2006.01)
*H05B 6/68* (2006.01)
*H01J 25/50* (2006.01)

(52) U.S. Cl.
CPC ..... *H01J 23/34* (2013.01); *H01J 25/50* (2013.01); *H05B 6/685* (2013.01)

(58) Field of Classification Search
USPC ..... 315/39.51
See application file for complete search history.

(56) References Cited

U.S. PATENT DOCUMENTS 4,873,408 A 10/1989 Smith
4,939,632 A 7/1990 Plagge
5,082,998 A 1/1992 Yoshioka
5,208,432 A * 5/1993 Han ..... H02M 1/10 219/716
5,642,268 A * 6/1997 Pratt ..... H05B 6/666 315/106
6,713,965 B2 * 3/2004 Jang ..... H05B 6/666 315/224
6,744,209 B2 * 6/2004 Jang ..... H05B 6/666 219/482
7,282,682 B2 * 10/2007 Suenaga ..... H05B 6/666 219/715
7,432,484 B2 * 10/2008 Moriya ..... H05B 6/685 219/716
8,143,816 B2 * 3/2012 Clayton ..... H05H 7/02 315/39.51
8,258,446 B2 * 9/2012 Suenaga ..... H05B 6/685 219/702
8,338,762 B2 * 12/2012 Suenaga ..... H05B 6/685 219/215
8,378,582 B2 * 2/2013 Kim ..... H01J 65/044 315/248
8,492,687 B2 * 7/2013 Suenaga ..... H05B 6/685 219/702
8,642,934 B2 * 2/2014 Suenaga ..... H05B 6/685 219/702

* cited by examiner

*Primary Examiner* — Douglas W Owens
*Assistant Examiner* — Srinivas Sathiraju
(74) *Attorney, Agent, or Firm* — Bay State IP, LLC

(57) ABSTRACT

A power supply for a magnetron has a PFC DC voltage source and an HV (High Voltage) converter. The voltage source is mains driven and supplies DC voltage above mains voltage on line, smoothed by capacitor to the HV converter. The latter supplies switched alternating current to transformer. This supplies higher voltage alternating current to a rectifier, in turn supplying the magnetron with high, magnetron powering, anode voltage on line. The DC voltage source has an PFC inductor, which is switched by a transistor switch under control of an integrated circuit. It is the inductor which enables the voltage source to provide a variable DC voltage. An input rectifier is provided for rectifying mains voltage. The output voltage of the voltage source is monitored and fed back to the integrated circuit by a voltage divider.

11 Claims, 1 Drawing Sheet

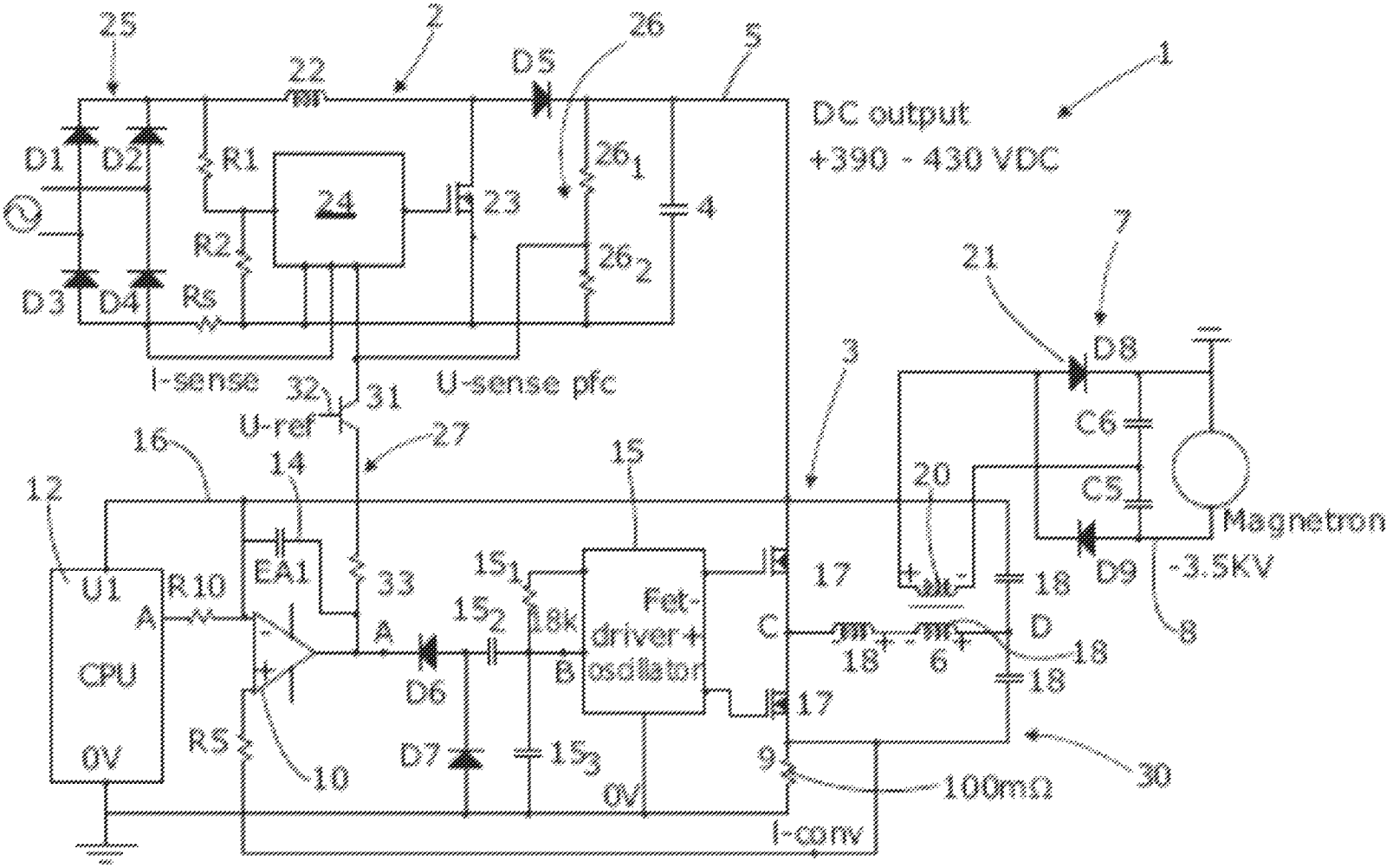
Magnetron
-3.5KV
DC output
+390 - 430 VDC
Fet-driver+oscillator
U-sense pfc
I-sense
U-ref
I-conv
CPU
0V
100mΩ
1
2
3
4
5
6
7
8
9
10
12
14
15
16
17
18
20
21
22
23
24
25
26
27
30
31
32
33
D1
D2
D3
D4
D5
D6
D7
D8
D9
C5
C6
R1
R2
R5
R10
EA1
U1

MAGNETRON POWER SUPPLY

CROSS REFERENCE TO RELATED APPLICATION

This application is for entry into the U.S. National Phase under §371 for International Application No. PCT/GB2011/001048 having an international filing date of Jul. 12, 2011, and from which priority is claimed under all applicable sections of Title of the United States Code including, but not limited to, Sections 120, 363, and 365(c), and which in turn claims priority under 35 USC 119 to United Kingdom Patent Application No. 1011789.3 filed on Jul. 13, 2010.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

1. Field of the Invention

The present invention relates to a power supply for a magnetron, in particular but not exclusively for use with a magnetron powering a lamp.

2. Description of the Related Art

Known magnetron power supplies include a converter circuit comprising:

- a converter adapted to be driven by a DC voltage source and produce an alternating current output, the converter having:
  - a resonant circuit including an inductance and a capacitance ("LC circuit") exhibiting a resonant frequency and
  - a switching circuit adapted to switch the inductance and the capacitance to generate a switched alternating current having a frequency greater than that of the resonance of the LC circuit;
- an output transformer for increasing the voltage of the output alternating current and
- a rectifier and smoothing circuit connected to a secondary circuit of the output transformer for supplying increased voltage to the magnetron.

Herein, we describe such a circuit as a "Magnetron, Switched Converter Power Circuit" or MSCPC.

In known magnetron power supplies, the DC voltage source for the converter normally includes (for regulatory reasons) power factor correction (PFC), to enable it to exhibit substantially ohmic characteristics when connected to alternating current mains.

Both the PFC voltage sources and the converters, that is the PFC stages and the converter stages, are usually high frequency switching devices, that is they incorporate electronic switches switched at high frequency with respect to the mains frequency. Both stages have efficiency characteristics whereby under some operating conditions their efficiencies drop off.

The efficiency of the PFC stage drops off when it is operated to generate an increasingly high DC voltage. The efficiency of the converter stage drops of when it is operated at higher switching frequency, further from resonance of its components, and when generating less current than its maximum current.

The dichotomy of maximum PFC efficiency at lower voltage and maximum converter efficiency mitigates against overall power supply efficiency.

SUMMARY OF THE INVENTION

The object of the present invention is to provide an efficient power supply.

According to the invention there is provided a power supply for a magnetron, the power supply including:

- a Magnetron, Switched Converter Power Circuit, the MSCPC having a control input and being adapted to generate increased voltage at a certain multiple of DC voltage applied to it when a normal control voltage or a control voltage deviating in one direction from the normal is applied to the control input, the one direction being ineffective on the multiple, and an increased voltage at a decreasing multiple with deviation of the control voltage from the normal in the other direction, the other direction being effective on the multiple, i.e. reducing it;
- a DC voltage source arranged to supply the DC voltage or the DC voltage together with an increase therein to the MSCPC;
- means for measuring power or current from the DC voltage source passing through the MSCPC for driving the magnetron;
- converter control means for applying a control voltage to the MSCPC in accordance with a function of the difference between a desired magnetron power and the said measured power or current; and
- DC voltage control means for passing deviation of the control voltage in the ineffective-on-the-multiple direction to the DC voltage source for causing it to supply the increased DC voltage to the MSCPC;

the arrangement being such that in use:

- when the converter control means applies the normal voltage to the MSCPC, the latter is supplied with the DC voltage and applies normal power to the magnetron for operating it at normal power,
- when the converter control means applies normal voltage deviated in the multiple-effective direction, the MSCPC is supplied with the DC voltage and applies less power to the magnetron for operating it at less than normal power and
- when the converter control means applies normal voltage deviated in the multiple-ineffective direction, the MSCPC is supplied with increased DC voltage and applies higher power to the magnetron for operating it at higher than normal power.

It is envisaged that the DC voltage control means for passing deviation of the control voltage may be a microprocessor programmed to control the power supply in the manner set out. However in the preferred embodiment, the DC voltage control means (DCVCM) for passing deviation of the control voltage is a hardware circuit for deriving the control voltage for the voltage source from the control voltage for the converter. In particular, the DCVCM is a hardware circuit provided between an output of the converter control means and a control input of the DC voltage source, the circuit being adapted and arranged to:

isolate the DC voltage source control input from the output of the converter control means, when the required magnetron output is normal or less, and to pass the control voltage deviated in the ineffective direction, or a signal corresponding to it, to the DC voltage source control input.

In the preferred embodiment, the converter control means is:

a microprocessor programmed to produce a control voltage indicative of a desired output power of the magnetron and an integrated circuit arranged in a feed back loop and adapted to apply a control signal to the MSCPC in accordance with a comparison of a voltage from the measuring means with the voltage from the microprocessor for controlling the power of the magnetron to the desired power.

Preferably, the measuring means is a resistor having the MSCPC current passing through it and generating the comparison voltage.

The preferred hardware circuit is a transistor circuit connected to the common point of a voltage divider controlling the voltage source, the transistor circuit biasing up the divider voltage only when more than normal power is required.

BRIEF DESCRIPTION OF THE DRAWINGS

To help understanding of the invention, a specific embodiment thereof will now be described by way of example and with reference to the accompanying drawings, in which:

FIG. 1 is a circuit diagram of a power supply in accordance with the invention.

DETAILED DESCRIPTION OF THE PREFERRED EMBODIMENTS

Referring to FIG. 1, a power supply 1 for a magnetron has a PFC DC voltage source 2 and an HV (High Voltage) converter 3. The voltage source is mains driven and supplies DC voltage above mains voltage on line 5, smoothed by capacitor 4, to the HV converter. The latter supplies switched alternating current to transformer 6. This supplies higher voltage alternating current to a rectifier 7, in turn supplies the magnetron with high, magnetron powering, anode voltage on line 8. The voltage source and the converter have efficiencies of the order of 95% or higher. Nevertheless, it is desirable to operate the entire power supply under conditions whereby the components are as efficient as practical as is the overall efficiency. This is particularly so in the case of a lamp powered by the magnetron. The latter requires more power than normal during start-up and to maintain its output towards the end of its life. This invention is directed towards providing for this and at the same time providing efficiency during normal operation. This latter is achieved by running both the DC voltage source and the HV converter at their most efficient conditions during normal operation.

Since the HV converter itself is efficient, it can be controlled by measuring the current through it in the reasonable expectation that the power supplied to the magnetron is close to that supplied to and passing through the HV converter. Accordingly the current through the converter could be passed through a low value resistor and the voltage across this fed to a microprocessor as an indicator of the current being supplied to the magnetron and indeed of the power supplied to it—assuming that the voltage supplied to the magnetron remains constant, as it does during most operating conditions, as explained in more detail below.

However, in this embodiment as in that of the preferred embodiment of our co-pending International patent application No PCT/GB2011/000920, dated 17 Jun. 2011, which describes an improvement in control of an HV converter, the voltage across the low value resistor 9 is fed to one input of an integrating, error amplifier 10 embodied as an operational amplifier. The microprocessor 12 supplies a signal indicative of the desired current for a desired power to the other input of the operational amplifier. The operational amplifier has an integrating, feed-back capacitor 14 and passes a voltage indicative of the required current to a frequency control circuit 15 for the HV converter, via input components $\mathbf{15}_1$, $\mathbf{15}_2$, $\mathbf{15}_3$. The microprocessor receives an input on line 16 indicative of the voltage-source voltage and computes the required current in accordance with a presently required power. The converter 30, also referred to as a Magnetron, Switched Converter Power Circuit, has switches 17 and LC components 18, including the primary of the transformer 6. The secondary 20 of the transformer feeds a rectifier 21 for applying DC anode voltage to the magnetron. The turns ratio of the transformer is such as to provide optimal anode voltage to the magnetron. Typically a ten to one ratio provides 3.5kV for normal magnetron operation.

The response to an input on line 16 of the HV converter is as follows:

when normal control voltage, i.e. a voltage appropriate for normal, full power operation of the magnetron, is applied to the converter, such as to control its current through the converter and the measurement resistor to be a maximum, it applies normal high voltage and power to the magnetron for its operation at normal high power. The high voltage is that of the DC voltage source times the turns ratio of the transformer;

when higher than normal control voltage is applied to the converter, causing the converter frequency to rise and its current to fall, it applies less than normal power to the magnetron. The nominal voltage does not change, the normal DC voltage being applied to the converter, but the inductive components of the converter impede and reduce the current, reducing the power to the magnetron. Operating the converter at less than normal power does involve running it off its most efficient state;

when less than normal control voltage is applied to the converter, it cannot pass more than its normal maximum current. However, as explained below, the greater than normal control voltage causes the DC voltage source to increase its voltage, whereby the converter applies greater than normal voltage and power to the magnetron. Operating the DC voltage source at greater than normal voltage does involve running it off its most efficient state.

The DC voltage source has an PFC inductor 22, which is switched by a transistor switch 23 under control of an integrated circuit 24. It is the inductor which to enables the voltage source to provide a variable DC voltage. An input rectifier 25 is provided for rectifying mains voltage. The output voltage of the voltage source is monitored and fed back to the integrated circuit by a voltage divider 26.

In accordance with the invention, this feed back voltage is modified as required to control the required voltage to be applied to the HV converter by a control circuit 27.

The HV converter is at its most efficient when operated at a frequency closely above the LC resonant frequency. Typically, this latter frequency is 50 kHz and the converter is operated between 52 kHz and 55 kHz. The HV converter is operated at the lower end of this range for normal magnetron operation and power. Operation above the lower end frequency, as may be required for reduced converter current and magnetron power as for dimming of the lamp driven by the magnetron, involves a reduction in efficiency. For such operation, the control circuit (for controlling the voltage of the voltage source) is inoperative, in not modifying the voltage generated by the voltage source. This involves one reduction in efficiency only, and avoids compounding a reduction of HV converter efficiency with a reduction of PFC voltage source efficiency.

During start up (particularly when starting in cold outdoor conditions) the magnetron requires high voltage and power. Also, when a higher voltage may be required towards the end of the life of the magnetron, or when it is running hot due to degraded cooling, a higher power to the magnetron is required. This is provided by maintaining the HV converter at its maximum current and efficiency and temporarily increasing the voltage. For this operation the control circuit operates to modify the feed-back voltage from the voltage divider 26.

The control circuit (for controlling the voltage of the voltage source) utilises the voltage from the current controlling operational amplifier. Whilst this voltage is at the level corresponding to normal current and magnetron power or indeed above this level—higher voltage corresponding to higher HV converter frequency and lower current to the magnetron—the control circuit is inoperative. When the microprocessor is calling for HV converter current above the norm, the operational amplifier output is reduced. The HV converter is at its lowest operational frequency—maximum current—and cannot react. The decreased voltage is passed to the voltage source, which can react and does so by increasing the voltage produced by the voltage source. This has the effect of increasing the power to the magnetron in the form of an increased anode voltage, which increases the anode current (as distinct from the HV converter current).

The control circuit comprises a transistor 31 having a reference voltage fed to its base on line 32. Its collector is connected to the common point of the voltage divider 26, which is the feed back point. The emitter is connected to the output of the operational amplifier via a resistor 33.

The values of the components particular to this embodiment are as follows:

| | |
|---|---|
| Serial current measurement resistor | 100 mΩ, i.e. 0.1 Ω |
| Feed-back resistor R5 | 470 Ω |
| Voltage control resistor 33 | 100 kΩ |
| Potential divider resistor $26_1$ | 2 MΩ |
| Potential divider resistor $26_2$ | 13 kΩ |
| Input resistor $15_1$ | 18 kΩ |
| Input Capacitors $15_2$, $15_3$ | 470 pF |
| Integrating Capacitor 14 | 470 nF |

The emitter voltage is determined by the base voltage, the former being lower. When the reference voltage on the base line 32 is set such that the emitter voltage is equal to the output voltage of the operational amplifier no current passes through the resistor 33, such as to disturb that voltage divider. Thus the collector voltage is determined solely by the voltage divider, which in turn causes the PFC voltage source to produce its normal DC voltage, enhanced above mains voltage in the normal way. This is the normal situation. In other words, the base voltage is set to cause the emitter voltage to equal the operational amplifier voltage corresponding to normal (and in fact maximum) HV converter current and normal magnetron power.

If the output from the operational amplifier increases, in response to an external control signal reducing the magnetron power by increasing the converter frequency, which decreases the anode current, the increased voltage is isolated from voltage divider for the voltage source, the base/emitter junction of the transistor being reverse biased.

If the output from the operational amplifier is decreased, calling for more magnetron power than the HV converter can deliver at the normal voltage, there is a potential difference across the resistor 33 in a direction such that current can and does flow. The voltage at the junction of the voltage divider 26 falls and the integrated circuit in the voltage source reacts to raise the voltage produced on the line 5, which has the effect of restoring upwards the divider junction voltage. The circuits stabilise, with increased power being supplied to the magnetron. If this is required for starting of the lamp, normal power is restored after a period. If it is required because the magnetron is reaching the end of its life, the increased power is maintained. Should the magnetron have degraded to such extent as to appear to require excessive power, the microprocessor will switch the power supply off by non-shown means.

It will be appreciated that the microprocessor does control the PFC voltage source, albeit via the intermediary of the control circuit.

The invention is not intended to be restricted to the details of the above described embodiment. For instance, the microprocessor can be programmed to maintain constant, or at least to the voltage divider value, the control voltage to the voltage-source integrated circuit; and to reduce the control voltage (to increase the line voltage 5) only when start-up or other abnormally high power is required.

Further in our co-pending International patent application No PCT/GB2011/000920, dated 17 Jun. 2011 there is described a second embodiment in which ripple in the voltage from the DC voltage source is compensated for, by adjusting the HV converter current concomitantly, in order to allow the magnetron power to be maintained constant throughout the ripple cycle. This achieved by connecting a resistor between the measurement input of the operational amplifier and the DC voltage line. This improvement can be made in the present invention as well.

The invention claimed is:

1. A power supply for a magnetron, the power supply including:

a Magnetron, Switched Converter Power Circuit (MSCPC), the MSCPC having a control input and being adapted to generate increased voltage at a certain multiple of DC voltage applied to it when a control voltage for full power operation of the magnetron or a control voltage deviating in one direction from the control voltage is applied to the control input, the one direction being ineffective on the multiple, and an increased voltage at a decreasing multiple with deviation of the control voltage from the control voltage in an other direction opposite the one direction, the other direction being effective on the multiple, i.e. reducing it;

a DC voltage source arranged to supply the DC voltage or the DC voltage together with an increase therein to the MSCPC;

means for measuring power or current from the DC voltage source passing through the MSCPC for driving the magnetron;

converter control means for applying a control voltage to the MSCPC in accordance with a function of the difference between a desired magnetron power and the said measured power or current; and DC voltage control means for passing deviation of the control voltage in the ineffective-on-the-multiple direction to the DC voltage source for causing it to supply the increased DC voltage to the MSCPC;

the arrangement being such that in use:

when the converter control means applies the voltage to the MSCPC, the latter is supplied with the DC voltage and applies power for full power operation to the magnetron, when the converter control means applies voltage deviated in the multiple-effective direction, the MSCPC is supplied with the DC voltage and applies less power than power for full operation to the magnetron and when the converter control means applies voltage deviated in the multiple-ineffective direction, the MSCPC is supplied with increased DC voltage and applies higher power to the magnetron.

2. A magnetron power supply as claimed in claim 1, wherein the DC voltage control means for passing deviation of the control voltage is a microprocessor programmed to produce a control voltage indicative of a desired output power of the magnetron to the MSCPC for controlling the power of the magnetron.

3. A magnetron power supply as claimed in claim 2, wherein the power or current measuring means is a resistor in series with the MSCPC, one end of the resistor being grounded and the other being connected to the MSCPC and to the microprocessor.

4. A magnetron power supply as claimed in claim 2, wherein the converter control means is an adaptation of the microprocessor programmed to control the voltage source in the manner set out.

5. A magnetron power supply as claimed in claim 1, wherein the converter control means is:

a microprocessor programmed to produce a control voltage indicative of a desired output power of the magnetron and an integrated circuit arranged in a feed back loop and adapted to apply a control signal to the MSCPC in accordance with a comparison of a voltage from the measuring means with the voltage from the microprocessor for controlling the power of the magnetron to the desired power.

6. A magnetron power supply as claimed in claim 5, wherein the power or current measuring means is a resistor in series with the MSCPC, one end of the resistor being grounded and the other being connected to the MSCPC and to an input of the integrated circuit, preferably via a feed back resistor.

7. A magnetron power supply as claimed in claim 5, wherein the integrated circuit is an operational amplifier connected as an error signal amplifier, the error signal being the difference between signals indicative of a measurement of the converter current and the desired output power of the magnetron.

8. A magnetron power supply as claimed in claim 6, wherein a ripple smoothing resistor is incorporated between the input of the integrated circuit having the series resistor connected to it and a DC voltage source line.

9. A power supply as claimed in claim 5, wherein the integrated circuit is arranged as an integrator with a feedback capacitor, whereby its output voltage is adapted to control a voltage-to-frequency circuit for controlling the converter.

10. A magnetron power supply as claimed in claim 5, wherein the DC voltage control means for passing deviation of the control voltage is a hardware circuit is provided between an output of the integrated circuit and a control input of the DC voltage source, the circuit being adapted and arranged to:

isolate the DC voltage source control input from the integrated circuit output, pass the control voltage deviated in the ineffective direction, or a signal corresponding to it, to the DC voltage source control input.

11. A magnetron power supply as claimed in claim 10, wherein the hardware circuit is an emitter- follower transistor circuit connected to bias the common point of a voltage divider controlling the DC voltage source, the transistor circuit biasing up the divider voltage only when more than control power is required.

* * * * *